US007026916B2

(12) United States Patent
Alexander

(10) Patent No.: US 7,026,916 B2
(45) Date of Patent: Apr. 11, 2006

(54) TABLETOP SIGNALING DEVICE FOR RESTAURANTS

(76) Inventor: Karin K. Alexander, P.O. Box 741, Glenwood, IL (US) 60425

( * ) Notice: Subject to any disclaimer, the term of this patent is extended or adjusted under 35 U.S.C. 154(b) by 220 days.

(21) Appl. No.: 10/683,295

(22) Filed: Oct. 14, 2003

(65) Prior Publication Data

US 2005/0077999 A1 Apr. 14, 2005

(51) Int. Cl.
*G08B 5/00* (2006.01)

(52) U.S. Cl. ..... 340/286.09; 340/286.06; 340/326; 340/332; 340/825.69; 340/825.72

(58) Field of Classification Search ..... 340/286.09, 340/286.06, 326, 332, 815.4, 815.45, 815.5, 340/825.69, 825.72, 7.2; 705/15, 26
See application file for complete search history.

(56) References Cited

U.S. PATENT DOCUMENTS

| | | | | |
|---|---|---|---|---|
| 2,465,426 | A | 3/1949 | Bralove | |
| 2,563,693 | A | 8/1951 | Russell | |
| 2,638,583 | A | 5/1953 | Edwards, Jr. | |
| 3,558,871 | A | 1/1971 | Rogers | |
| 3,714,410 | A | 1/1973 | Olsen | |
| 4,250,491 | A | 2/1981 | Dotson | |
| 4,926,786 | A | 5/1990 | White | |
| 5,828,294 | A * | 10/1998 | Shank | 340/326 |
| 5,926,111 | A * | 7/1999 | Davis et al. | 340/825.63 |
| 6,164,796 | A | 12/2000 | La Chiusa | |
| 6,366,196 | B1 * | 4/2002 | Green et al. | 340/286.09 |
| 6,782,974 | B1 * | 8/2004 | Leifer | 186/35 |
| 6,810,343 | B1 * | 10/2004 | McKee | 702/81 |
| 2002/0147647 | A1 | 10/2002 | Ragdale-Elliott et al. | |

FOREIGN PATENT DOCUMENTS

| | | |
|---|---|---|
| DE | 19622309 | 11/1997 |
| GB | 2344443 A | 7/2000 |

* cited by examiner

*Primary Examiner*—Hung Nguyen
(74) *Attorney, Agent, or Firm*—Richard C. Litman

(57) ABSTRACT

The tabletop signaling device for restaurants comprises a tabletop signaling device for visually signaling at least one of a plurality of messages to a waiter or waitress quickly and wordlessly, without requiring the service provider to physically respond and inquire to the requested service. The signaling device includes a plurality of light sources and switches for illuminating vertically spaced panels disposed on the front of the signaling device, each panel having predetermined and distinct indicia disposed thereon for signaling a specific message. A table available button disposed on the tabletop signaling device operates to illuminate a corresponding lamp disposed on a remote display panel for signaling the availability of the table. The lamps on the remote display panel may be arranged according to the location of the tables on the floor of the restaurant.

17 Claims, 6 Drawing Sheets

TABLETOP SIGNALING DEVICE FOR RESTAURANTS

BACKGROUND OF THE INVENTION

1. Field of the Invention

The present invention relates to signaling devices, specifically a lighted tabletop device for conveying a plurality of messages from a table, such as in a restaurant, to a waiter.

2. Description of the Related Art

The common way to call a waiter or a waitress for service has been in the manner of raising a hand or raising one's voice. In today's restaurants, especially in fast-paced family restaurants, the low ratio of waiters or waitresses to tables nearly guarantees that in the time it takes for a waiter to first respond to one's signal, and then return with the requested item, you have either lost your appetite, or have taken direct action and seized the desired silverware, napkins, or salt from another table. Such an inefficient operation not only detracts from patron satisfaction, but also has a detrimental impact on revenue. Waiting ten minutes for the waiter or waitress to appear in order to request the check slows down the income stream, increases table turnover time, does nothing to increase customer satisfaction, and may even result in a loss of customers. Devices addressing these problems have been developed and encompass a wide range of devices, from technically sophisticated communication devices on the one hand, to simplistic devices offering rudimentary non-electric "on"/"off" signaling capability on the other.

U.S. Pat. No. 2,465,426, issued to Bralove in March 1949, discloses a self-contained visual signal device operated by a patron to catch the attention of a waiter or waitress. The '426 invention has only two modes of operation, "on" and "off" with no means for communicating any further intelligence. The waiter or waitress must first determine the object of desire and then make a return trip back to the table. U.S. Pat. No. 2,563,693, issued to C. G. Russell in August of 1951, discloses a similar flashlight device for signaling a waiter comprising a napkin holder having a tubular lamp and switch for operating the lamp.

U.S. Pat. No. 2,638,583, issued to G. B. Edwards, Jr. in May 1953, discloses a table signaling flashlight comprising a vertical cylindrical housing, a lamp, and a switch whereby a waiter is signaled by operation of the lamp. Additional devices providing a visual signal to a waiter included U.S. Pat. Nos. 3,558,871, 3,714,410, 4,250,491, and 6,164,796. All of these devices provide a single "on" state, thereby providing the waiter or waitress of a request for service, with no means of differentiating the type of service required.

Unlike the previous disclosed devices, U.S. Pat. No. 4,926,786, issued to Thomas C. White in May 1990, discloses a device which includes at least two indicators for signaling multiple messages to a waiter. The '786 patent is not electrified and has movable painted indicators for attracting the attention of the waiter.

U.S. patent Publication No. 2002/0147647, published October 2002, discloses a more sophisticated waiter-signaling device, providing an interactive, electronic communication device for expediting and resolving menu orders made by local and remote patrons. The device includes a pager unit having multi-line scrolling and buffer capabilities for receiving and transmitting messages from a touch-screen device on the patron's table.

Similarly, United Kingdom Patent No. 2,344,443, published in July 2000, discloses a receiver in the possession of a waiter and a transmitter on every table whereby the waiter is alerted by an auditory or vibratory signal when the guest depresses a single key on the transmitter.

German Patent No. 19,622,309, published in November 1997, discloses a decorative candlestick on each dining table, the candlestick having light-emitting diodes, which are switched on by a patron, whereby the table number is illuminated and a radio signal is sent from an antenna to light the corresponding lamp at a central control desk.

None of the above inventions and patents, taken either singly or in combination, is seen to describe the instant invention as claimed. Thus a tabletop signaling device for restaurants solving the aforementioned problems is desired.

SUMMARY OF THE INVENTION

The tabletop signaling device for restaurants includes a tabletop device for visually signaling at least one of a predetermined selection of messages to a waiter or waitress quickly and wordlessly, without requiring the service provider to first inquire as to the nature of the requested service.

The signaling device has several embodiments, one embodiment having a base horizontal unit and a vertical housing mounted on the base. The vertical housing has multiple rows, each row having a panel, which is selectively illuminated by light sources behind the panel and activated by a side-mounted lever or a vertical touch strip disposed to the left of the rows, the touch strip having a fingertip depression alongside each row. Each panel has predetermined and distinct indicia disposed thereon for signaling a specific message to a waiter or waitress. The panels may be made of glass, plastic, or other material and the panels may each have a distinctive color, color-coded to allow the waiter or waitress to quickly discern the requested service. The tabletop signaling device may also have an audible alert capability for providing a short audible signal when a row is illuminated.

An alternate embodiment of the signaling device incorporates a single light diffusing cover, which may be a translucent screen or dome, and a plurality of colored light sources disposed behind the cover. The individual messages are communicated by illuminating the cover with distinct colors, each color representing a specific message. The message and corresponding colored lamp is selected by means of switches or a multi-button keypad and control logic.

Operating in conjunction with the tabletop signaling device is a remote table availability display unit for indicating which tables in the restaurant are available for seating. A button disposed on the tabletop signaling device and operated by restaurant personnel causes a signal to be wirelessly transmitted to the display unit located within the restaurant. The display unit has a display panel representing the floor plan of the restaurant, with a lighted pushbutton mounted at locations generally corresponding to each table location. Receiver circuitry and lamp control logic within the display unit illuminates the lamp corresponding to the transmitting signaling device. The pushbutton associated with the lamp operates to toggle the state of the associated lamp to either reset the lamp or to manually light the lamp.

Accordingly, it is a principal object of the invention to provide a tabletop signaling device for restaurants which includes a self-contained, electrically energized visual and audible signal adapted to be set on top of each restaurant table by which a patron may readily signal to the waiter or waitress a plurality of different service requests.

It is another object of the invention to provide a tabletop signaling device for restaurants so that table attendants may ensure prompt service to a number of tables while obviating the need for frequently stopping at the table to inquire if additional services are required.

It is a further object of the invention to provide a tabletop signaling device for restaurants for signaling to a remote location the availability of a table in the restaurant.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a tabletop signaling device for use in restaurants and similar environments where it would be advantageous for a patron to be able to signal a plurality of service requests to a waiter or waitress quickly and wordlessly, without requiring the service provider to first ascertain the requested service and then return with the requested item.

Figure 1:
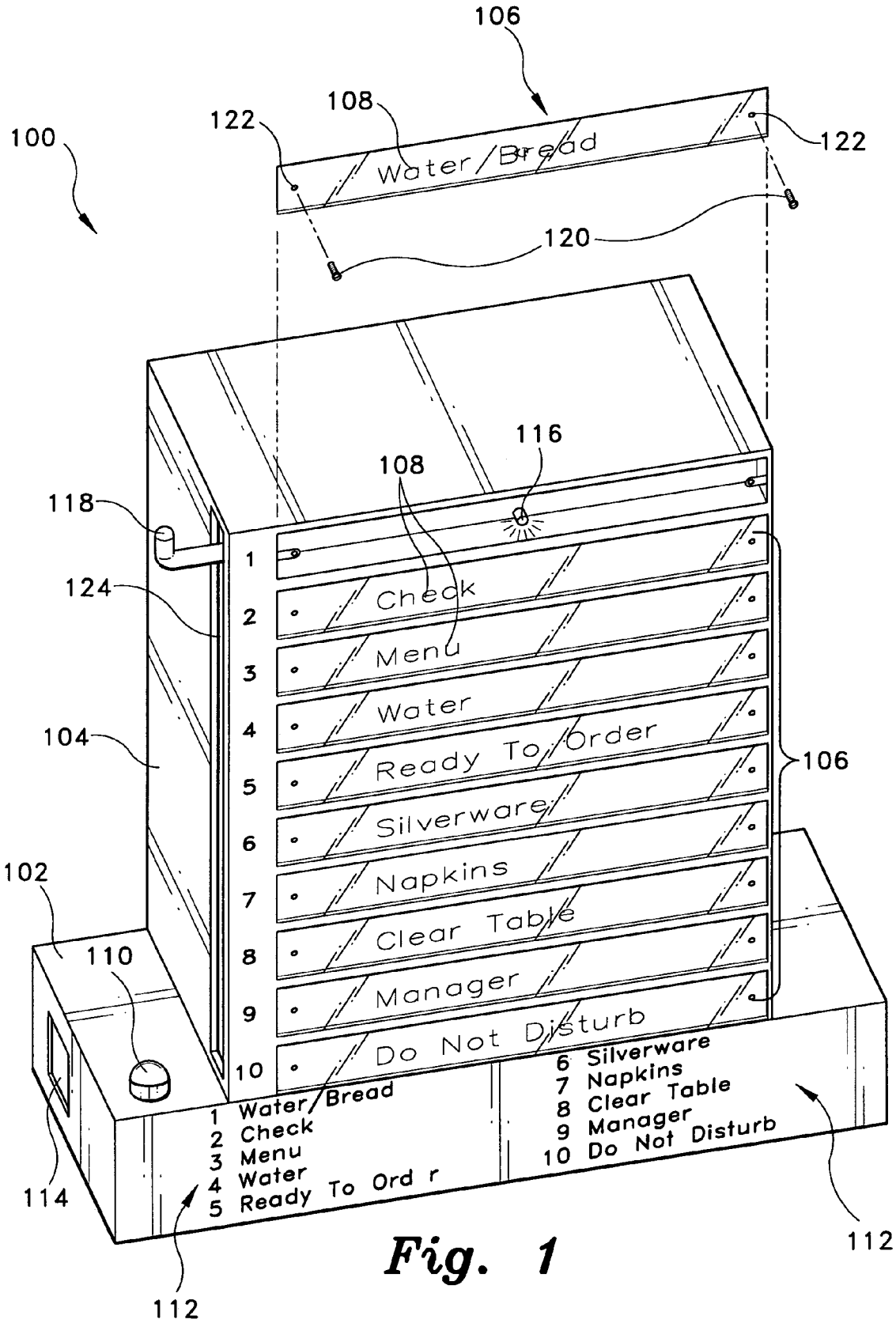
FIG. 1 is a perspective view of a tabletop signaling device for restaurants according to the present invention having a plurality of lighted panels activated by a sliding lever.

As shown in FIG. 1, the tabletop signaling device for restaurants includes a tabletop signaling device 100 having a base 102 adapted to be supported by the surface of a restaurant table. The base 102 is rectangular, approximately 7 inches long, approximately 2 inches high, and 2–3 inches deep. The base 102, which may be weighted to provide a lower center of gravity, has mounted thereon an upstanding housing 104 approximately 7 inches high, the housing having a front, two sides and a back. In its preferred embodiment, the base 102 and the upstanding housing 104 is made of plastic, although aluminum or other rigid material may be used depending upon the particular environment. Contained within base 102 are a battery compartment 114, an on/off witch 110, and a legend 112 disposed on the front of base 102. The legend 112 provides the patron with the different messages available to be signaled to the service provider. An almost unlimited variety of possible messages are possible, by no means limited to those messages shown in FIG. 1, and which may be modified as required by the specific business environment.

Disposed on the front of the upstanding housing 104 is a plurality of vertically spaced panels 106, each panel is approximately 1 inch high, having a length somewhat less than the width of the upstanding housing 104. The exact height of each panel 106 may vary depending upon the number of rows, the composition of the panel, and the desired esthetics of the tabletop signaling device. Although the panels 106 may be formed from any substantially rigid material, the panels 106 in the preferred embodiment are comprised of a lightweight material having transparent or translucent light transmitting characteristics including plastic, PLEXIGLAS®, or glass, either clear or stained. Furthermore, in order to provide increased row differentiation when viewed from afar, the panels may be color-coded. Colors for stain-glass panels are listed, but not limited to the colors listed in Table 1.

TABLE 1

| |
|---|
| DEEP RED |
| YELLOW |
| DARK HUNTER GREEN |
| LIGHT-GREEN |
| GREEN |
| AQUA |
| TURQUOISE |
| CHECKERED TURQUOISE AND RED |
| CHECKERED TURQUOISE AND YELLOW |
| DEEP PINK |
| DEEP PURPLE |

Although panels 106 are mounted to the housing 104 by means of screw fasteners 120 passing through apertures 122 cut through the panels and received by mounting tabs, any known fastening means, i.e. slide mounts, may be employed whereby each panel 106 may be removed for cleaning, replacing, or for maintenance of the signaling unit 100.

Mounted behind each panel 106 is a light source 116, each light source 116 being electrically connected to a switch, which operates to provide current from a battery received by battery holder 114 to illuminate the light source behind a selected panel. The switch is manually operated by means of a vertical slide lever 118 extending from slot 124 vertically disposed on one side of the upstanding housing 104. Optionally, the circuitry contained within the signaling unit, and to be discussed in detail later, may provide for a light flashing pability that operates to cause a predetermined panel to illuminate in a flashing mode in order to better gain the attention of the waiter.

Disposed on each panel 106 is a message 108 correlating to a corresponding message contained within the legend 112 on base 102. The message indicia 108 may be etched into the surface of each panel 106, or, alternatively, each panel 106 may be opaque with the indicia 108 formed by apertures cut through the body of the plate thereby allowing light transmitted by light source 116 to pass through the aperture, thereby illuminating the message disposed thereon. As a further alternative, messages printed on paper inserts may be received by a slotted row and illuminated from behind. A protective transparent panel, not shown, may cover the plurality of panels, protecting the panels from sliding or from the attention of impatient customers.

The tabletop signaling device 100 operates under control of electronic circuitry disposed on a printed circuit board contained within the base 102 and is powered by at least one battery contained with battery compartment 114. The present embodiment has a microcomputer chip mounted on the printed circuit board to control the various functions of the device, the design and programming of which is known to those knowledgably in the field.

Figure 2:
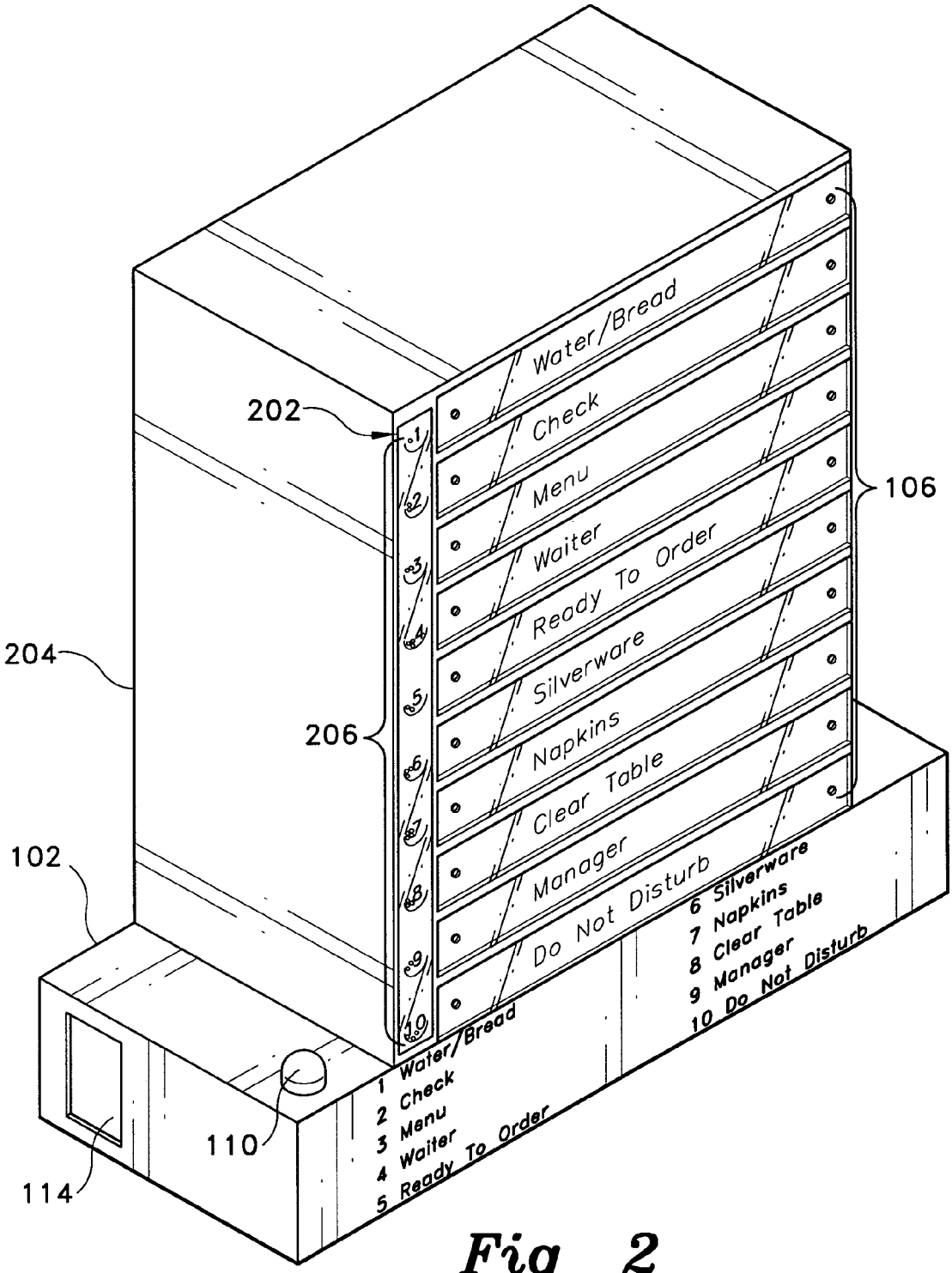
FIG. 2 is a perspective view of a second embodiment of a tabletop signaling device according to the present invention having touch control pushbuttons.

An alternative embodiment of the tabletop signaling device of the present invention, designated as 200, is shown in FIG. 2 and discloses an upstanding housing 204 similar to that disclosed in FIG. 1. However, in place of the slide lever 118 of FIG. 1 activating a hidden switch, the device 200 has instead a touch control strip 202 vertically disposed to the left of the rows of panels 106. The touch control strip 202 has fingertip depressions 206 alongside each panel and operates to illuminate the associated panel. Touch controls are known to those in the field and operate by detecting changes in capacitance, thin-film technology, magnetic inductance, changes in optical characteristics or any of a variety of known technologies. Touching the fingertip depressions 206 will cause the corresponding panel 106 to illuminate, and a subsequent touch will turn the light off. The surface of the touch control strip 202 may also have Braille indicia disposed thereon for the benefit of the blind and visually impaired. An additional function available in this second embodiment 200 is the capability of a patron to select multiple messages by "touching" multiple depressions 206 on the touch strip 202. Selected panels will be illuminated until a subsequent "touching" of the corresponding fingertip depression 206.

Figure 3A:
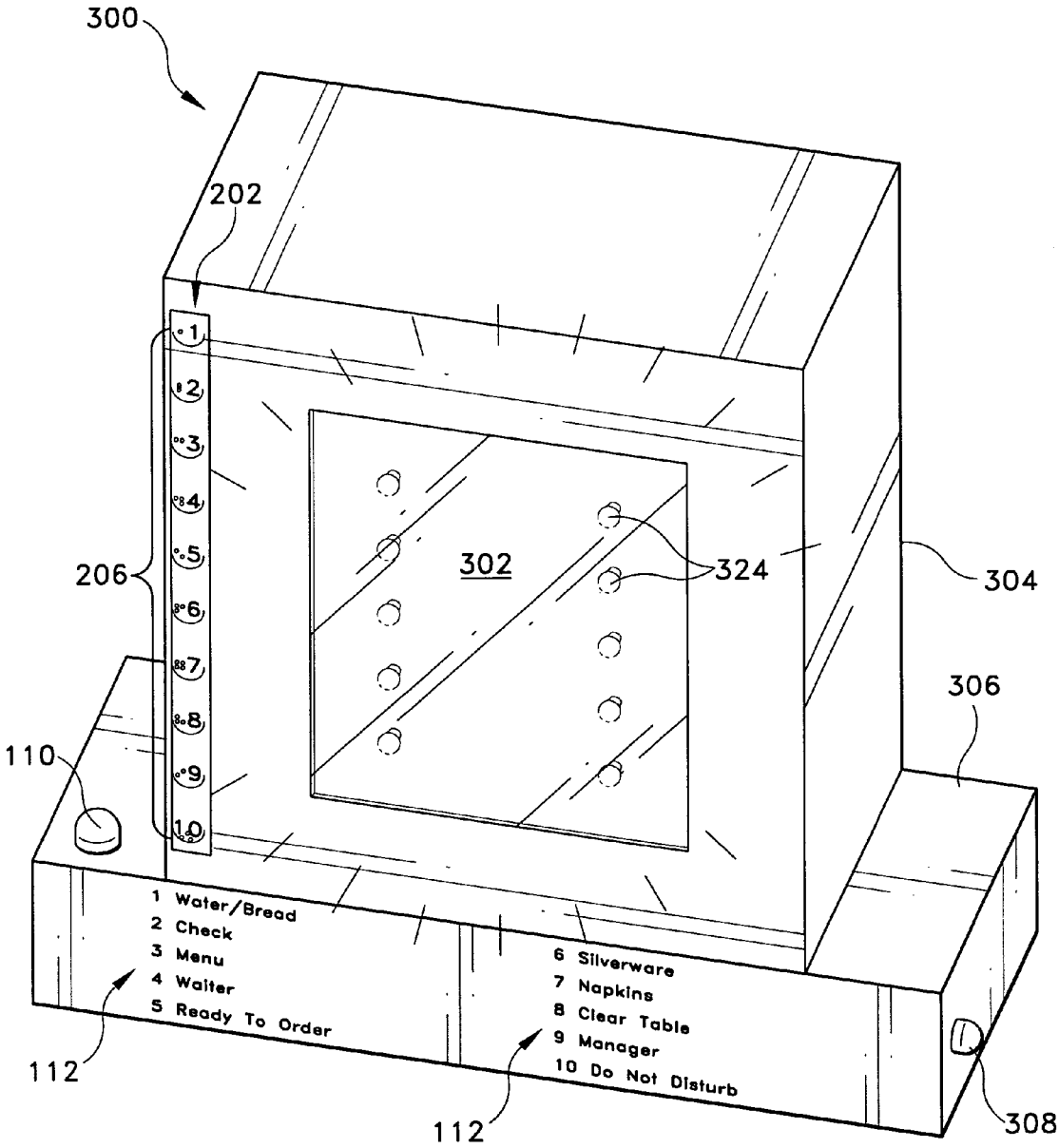
FIG. 3A is a perspective view of a third embodiment of a tabletop signaling device according to the present invention having an illuminating plate with touch control pushbuttons and a table availability push button.

A further embodiment of the tabletop signaling device, designated as 300, is shown in FIG. 3A and discloses a single translucent vertical lens or screen 302 having a plurality of colored lamps 324 disposed behind the screen 302. Each lamp 234, when selected by means of fingertip control strip 202 emits light of a uniquely discernable color, thereby causing translucent screen 302 to softly glow, alerting a waiter or waitress to a request color-coded to the visible indication. The screen 302 may be formed of an acrylic resin, such as Lucite® (a trademark of E.I. du Pont de Nemours & Co.) or other plastic or glass material having translucent or transparent optical characteristics.

Figure 3B:
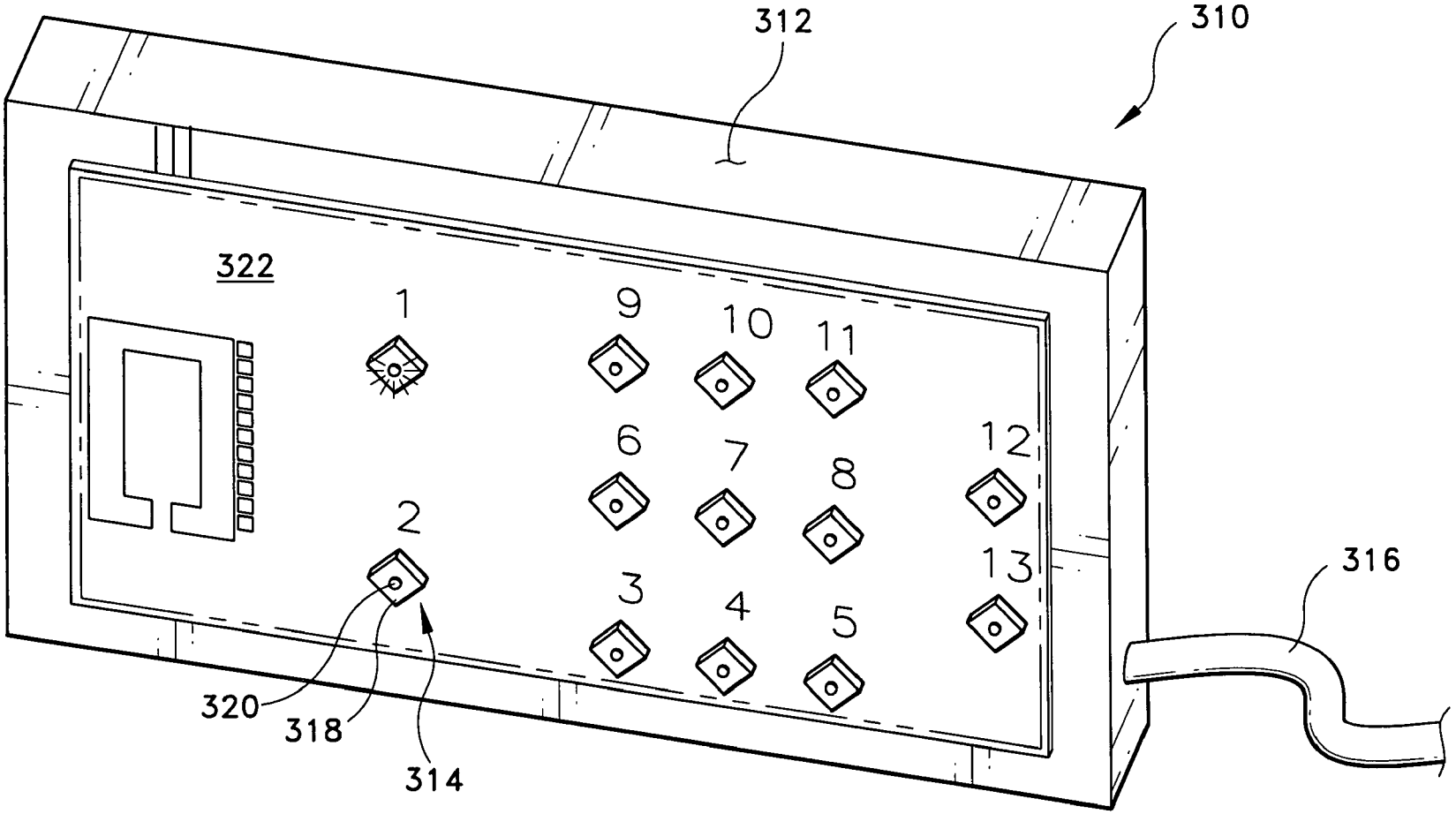
FIG. 3B is a table availability display unit in wireless communication with the signaling device of FIG. 3A.

A push button 308 is disposed within base 306 and serves to alert the hostess when the table is available for seating. Depressing button 308 activates a wireless transmission to a table availability display unit 310 shown in FIG. 3B. The table availability display unit 310 is located at the hostess station within a reasonable distance from the tabletop signaling devices on top of each table in the restaurant. The display unit 310 provides a seating hostess with information regarding the availability of tables. The display unit 310 has a base 312 adapted to rest on top of a table. The base 312 houses lamps, switches and logic and may be formed of plastic or metal. A display panel 322 is disposed in the front or user viewable surface of the unit 310 and has a plurality of lighted pushbutton assemblies 314 mounted on the display panel 322 arranged in a pattern resembling the floor plan of the restaurant. The button portion 318 of the lighted pushbutton assembly 314 operates to toggle the state of the lamp 320. Normally designed for use by a waiter or bus boy after clearing the table, depressing pushbutton 308 causes a signal to be transmitted to the table availability display unit 310. The display unit 310 may be battery powered, or as shown in FIG. 3B, may be powered by power cord 316 plugged into a standard 120-volt outlet.

Figure 4:
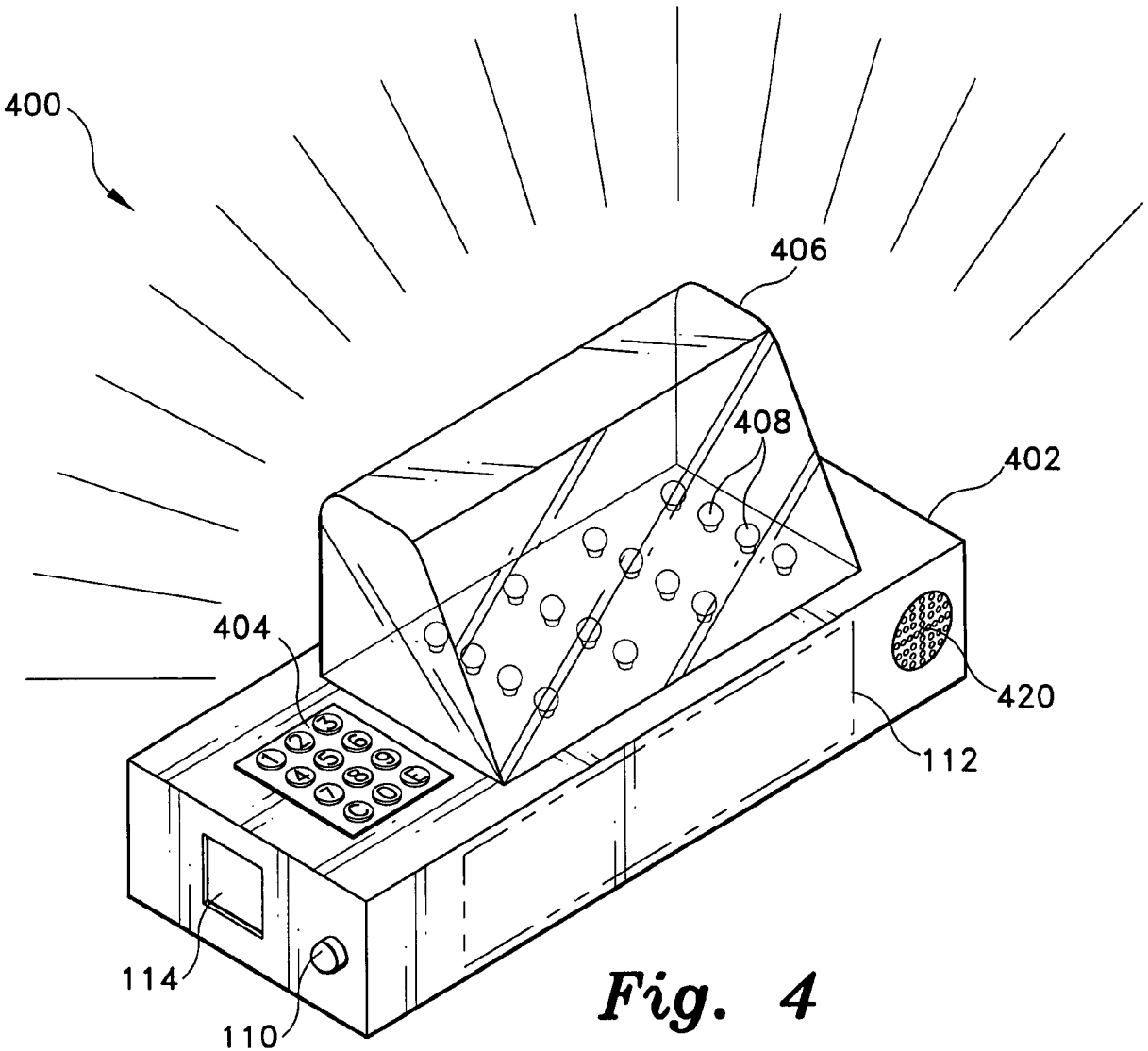
FIG. 4 is a perspective view of a fourth embodiment of the present invention having an illuminating diffuser and keypad.

A further embodiment of the tabletop signaling device is designated as 400 in FIG. 4 and replaces the touch strip 202, with a standard alphanumeric keypad 404 of a type commonly known in the field of electronics for entering data. Similar to the tabletop signaling unit 300 of FIG. 4, signaling unit 400 incorporates a single base structure 402, keypad 404 disposed on its surface, and a translucent light diffusing dome 406 covering a plurality of distinctly colored lights 408. Using the keypad 404 to enter the message number corresponding to the displayed legend 112 followed by the enter key "E", will cause the associated colored lamp 408 to illuminate. Keying the "C" key will clear the message. As previously disclosed by the discussion of FIG. 3A, the colored light is diffused by dome 406 and the intensity of the light diffused by the surface of the dome 406 is sufficient to attract the attention of a waiter and communicate the message corresponding to the color.

FIG. 4 further discloses a speaker 420 mounted on base 402 for producing an audible sound or musical tone electronically generated within base unit 402 when a message is selected. The audible capability is not limited to the embodiment shown in FIG. 4 and may be incorporated in the previous embodiments, whereby a pleasing audible signal is generated when a specific panel is activated either by the touch screen 202 in FIG. 2 or the lever 118 in FIG. 1.

As in the previous embodiments, the tabletop signaling device 400 shown in FIG. 4 allows a patron to select multiple messages. Subsequent messages selected without first clearing the previous message will cause the lights to cycle through the selected messages at a predetermined duty cycle. Alternatively, the table signaling device may be programmed to have a subsequent selected message override the previous message thereby avoiding the distraction of blinking lights throughout the establishment. Similar to embodiment 300, the tabletop signaling unit 400, disclosed in FIG. 4, is capable of transmitting a table available message to a table availability display unit 310 shown in FIG. 3B.

Figure 5:
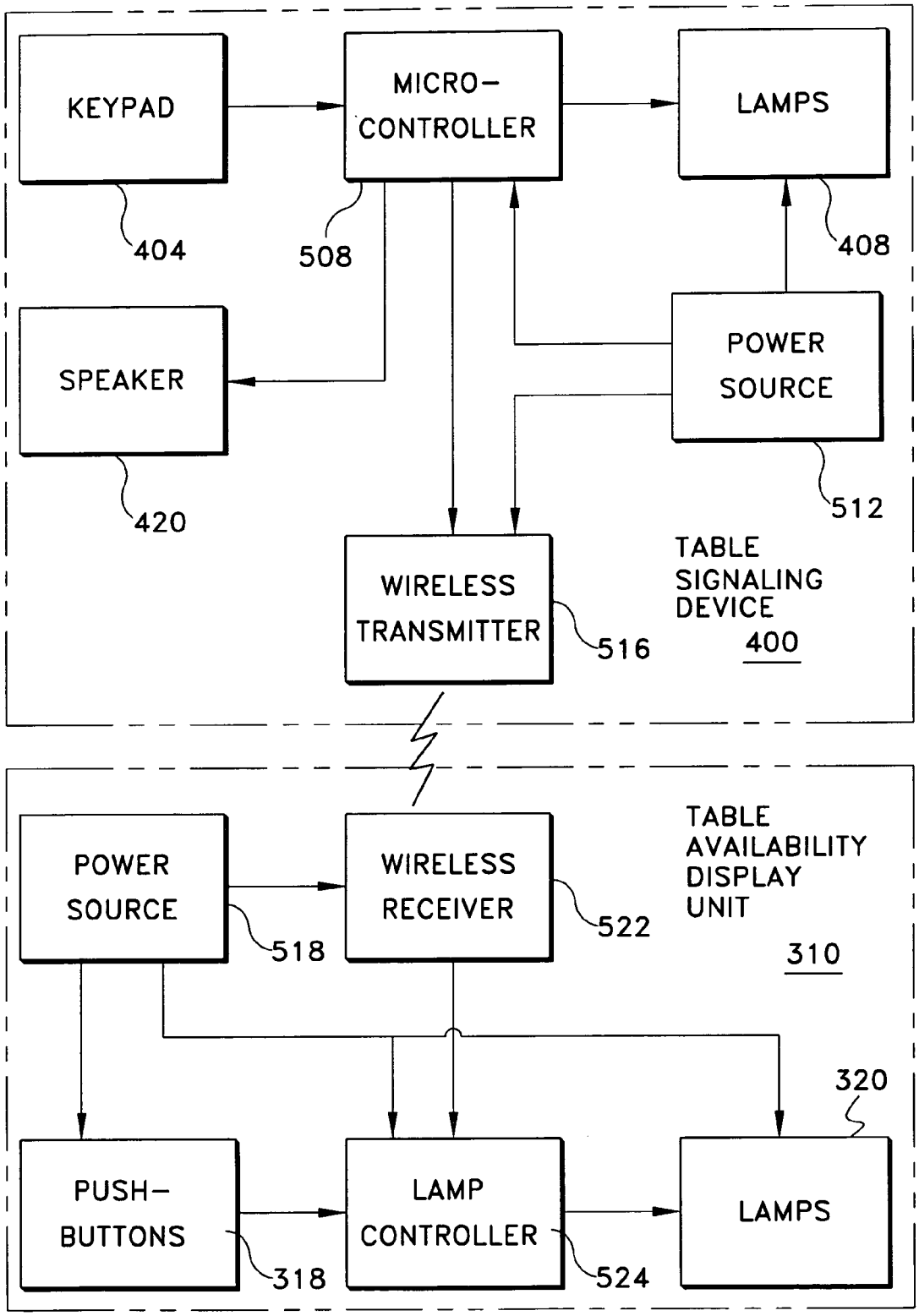
FIG. 5 is a representative block diagram of the tabletop signaling device according to the present invention.

The representative block diagram of FIG. 5 discloses the interoperation of the tabletop signaling unit 400 with the table availability unit 310. The basic blocks of the signaling unit 400 include a keypad 404 for selecting a message to be signaled, lamps 408, a power source 512, a speaker 420, an FM wireless transmitter 516 located in base 402 of the signaling unit 400 to signal table availability, and a microcomputer and controller logic 508 for controlling the illumination of selected lamps, controlling the generation of audible tones, and controlling the wireless transmitter 516. The power source 512, may be a battery received by battery holder 114, or may include an AC/DC power module connected by a power cord to standard AC power.

FIG. 5 includes a representative block diagram of the table availability unit 310, and shows the interoperation of the lamps 320, pushbuttons 318, wireless receiver logic 322, power source 518, which may be an AC/DC power module connected to standard AC power, and a lamp controller 524, which may be discrete electronic components or may contain a microcontroller to provide additional functionality and reduce manufacturing costs.

The wireless transmitter 516 in the tabletop signaling unit 400 and the wireless receiver 522 in the table display unit 310 communicate using the FM band. Wireless devices of this type communicate over short distances, require minimum power, and are commonly known in the electronics art.

It is to be understood that the present invention is not limited to the embodiments described above, but encompasses any and all embodiments within the scope of the following claims.

I claim:

1. A tabletop signaling device for a restaurant, comprising:

a base having a front, a top surface, two sides and a back;

an upstanding housing mounted on the base, the housing having a front, two sides and a back;

a plurality of vertically spaced panels disposed on the front of the housing, each panel having predetermined and distinct indicia disposed thereon;

at least one light source disposed behind each of said plurality of panels;

switch means for selectively illuminating the at least one light source behind the plurality of panels;

an on/off switch;

a battery holder for receiving a battery, the battery holder electrically connected to the switch means and light source;

a table availability switch disposed in the housing and a wireless transmitter electrically connected to the table availability switch;

a table availability display unit external to said tabletop signaling device, said table availability display unit comprising:

a display housing having a front display panel;

receiver circuitry disposed in the display housing, the receiver circuitry in wireless communication with said wireless transmitter;

lamp control circuitry disposed in the display housing, the lamp control circuitry in electrical communication with the receiver circuitry;

a plurality of lamps disposed in the front display panel, each of said plurality of lamps in electrical communication with the lamp control circuitry;

a plurality of switches disposed in said front display panel, each of the plurality of switches in electrical communication with one of said plurality of lamps, whereby toggling the state of one of said plurality of switches toggles the operative state of one of said plurality of lamps; and a voltage means for providing an operative voltage to the table availably display unit.

2. The tabletop signaling device according to claim 1, wherein said indicia is etched into each of said plurality of panels.

3. The tabletop signaling device according to claim 1, wherein each of said plurality of panels is formed of light transmitting material.

4. The tabletop signaling device according to claim 1, further comprising legend indicia disposed on said base corresponding to the indicia disposed on said plurality of panels.

5. The tabletop signaling device according to claim 1, further comprising a lever disposed on one side of said housing cooperatively engaging said switch means.

6. The tabletop signaling device according to claim 1, wherein said switch means comprises a touch control strip.

7. The tabletop signaling device according to claim 1, further comprising an audible tone generator activated by said switch means.

8. The tabletop signaling device according to claim 1, wherein said wireless transmitter is a radio transmitter operating in the FM band.

9. The tabletop signaling device according to claim 1, wherein said plurality of lamps is arranged in a predetermined pattern.

10. A tabletop signaling device, comprising:

a housing having a front, a top, a left and right side and a back;

a light transmitting cover disposed on the housing;

a plurality of colored light sources mounted on the housing behind the cover, the color of each light source distinctly different from each other;

switch means disposed on the housing, the switch means operative to selectively illuminate each of the plurality of colored light sources;

legend indicia disposed on the housing, the legend indicia operative to correlate a specific message with a corresponding switch means and colored light sources;

a power means for providing an operative voltage and current to the signaling device;

a table availability display device in electrical communication with the tabletop signaling device, the table availability display means comprising:

a table availability display housing having a table display panel mounted thereon;

a plurality of lamp/switch assemblies disposed in the table display panel, each of the plurality of lamp/switch assemblies having separate lamp and switch portions corresponding to a restaurant table upon which said table signaling device is placed;

a table availability switch means disposed in said table signaling device, the switch means operative to illuminate the lamp portion of a predetermined lamp switch assembly on the table display panel of the table availability display device;

lamp control circuitry disposed in the table availability display housing, the lamp control circuitry in electrical communication with the table availability switch means disposed in said tabletop housing; and a voltage means disposed within the table availability display housing for providing an operative voltage to the table availability display device.

11. The tabletop signaling device according to claim 10, wherein said cover is a dome disposed on the top surface of said housing.

12. The tabletop signaling device according to claim 10, wherein said cover is a vertical panel disposed on the front of said housing.

13. The tabletop signaling device according to claim 10, further comprising an audible signal generator and speaker activated by said switch means.

14. The tabletop signaling device according to claim 10, wherein said switch means further comprises a keypad having a plurality of pushbutton keys.

15. The tabletop signaling device according to claim 10, wherein said switch means further comprises a touch control strip with fingertip selection of each of said plurality of colored light sources.

16. The tabletop signaling device according to claim 10, wherein the tabletop signaling device communicates with said table availability display device by wireless communication.

17. The tabletop signaling device according to claim 10, wherein each of said plurality of lamp/switch assemblies is disposed on said table display panel in a predetermined pattern.

* * * * *